US006047990A

United States Patent [19]

Mogelonsky et al.

[11] Patent Number: 6,047,990

[45] Date of Patent: Apr. 11, 2000

[54] REPORT COVER SYSTEM WITH TUCK CLOSURE

[75] Inventors: Larry Leibe Mogelonsky, Toronto; Spencer Wynn, Scarborough; Douglas G. Schwartz, Montreal, all of Canada

[73] Assignee: Post-Fax Inc., Montreal, Canada

[21] Appl. No.: 08/910,417

[22] Filed: Aug. 13, 1997

Related U.S. Application Data

[60] Provisional application No. 60/028,650, Oct. 18, 1996.

[51] Int. Cl.[7] ..... B42D 1/00

[52] U.S. Cl. ..... 281/29; 281/21.1; 281/15.1; 402/73; 402/74

[58] Field of Search ..... 281/15.1, 46, 48, 281/29, 21.1; 402/73, 74

[56] References Cited

U.S. PATENT DOCUMENTS

| | | | |
|---|---|---|---|
| 568,305 | 9/1896 | Hano . | |
| 1,659,395 | 3/1927 | Douglas . | |
| 1,918,773 | 7/1933 | Morehouse . | |
| 2,114,944 | 4/1938 | Thomas . | |
| 3,995,752 | 12/1976 | Harrigan | 229/75 |
| 4,014,434 | 3/1977 | Thyen | 206/63.3 |
| 4,139,216 | 2/1979 | St. Clair | 281/4 |
| 4,486,032 | 12/1984 | Leahy | 281/46 |
| 4,519,629 | 5/1985 | Podosek | 281/25 |
| 4,548,426 | 10/1985 | Lockhart | 281/29 |
| 4,575,123 | 3/1986 | Giblin et al. | 281/48 |
| 4,706,994 | 11/1987 | Lockhart | 281/29 |
| 4,750,609 | 6/1988 | Felis | 206/1.7 |
| 4,934,738 | 6/1990 | Colonna | 281/28 |
| 4,971,361 | 11/1990 | Whiting | 281/2 |
| 5,011,188 | 4/1991 | Zoland et al. | 281/30 |
| 5,215,398 | 6/1993 | White et al. | 402/73 |
| 5,236,226 | 8/1993 | Sheffield | 281/48 |
| 5,407,230 | 4/1995 | Brink et al. | 281/15 |
| 5,435,598 | 7/1995 | Robinson | 281/45 |
| 5,445,251 | 8/1995 | Redwood | 190/109 |
| 5,727,816 | 3/1998 | Ong | 281/29 |
| 5,806,894 | 9/1998 | Dottel | 281/38 |

OTHER PUBLICATIONS

Meriam's Webster Collegiate Dictionary, 10th edition, p 1141, col. 1, line 25, 1997.

*Primary Examiner*—Willmon Fridie, Jr.
*Assistant Examiner*—Alisa L. Thurston
*Attorney, Agent, or Firm*—Virginia H. Meyer. Esq.; Mark J. Spolyar, Esq.

[57] ABSTRACT

The present invention provides a new report cover system that is useful for providing the user with a convenient, integrated tuck closure device for securing the front cover and thereby enclosing the desired report contents. The present invention also provides a report cover system with a novel information layout, wherein an inner face of the report cover and any text or other materials printed on, attached thereto, or visible therethrough, are visible as the user turns the pages of the report contents. The report cover system includes back cover means, a front cover, and at least one front cover strip, to which the report contents are attached, such that there is a groove by and between the report contents and an inner face of the front cover strip(s). The new report cover is closed by tucking an edge of the front cover into the groove created by and between the front cover strip and the report contents attached thereto. Any suitable means can be used to secure the report contents to the front cover strip(s), including staples, adhesive, and fasteners.

22 Claims, 9 Drawing Sheets

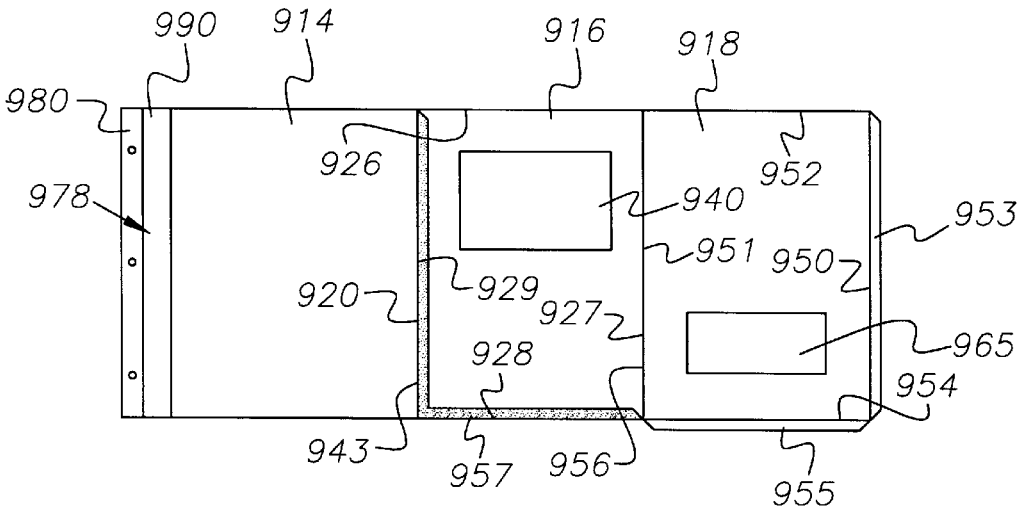
FIG. 21A
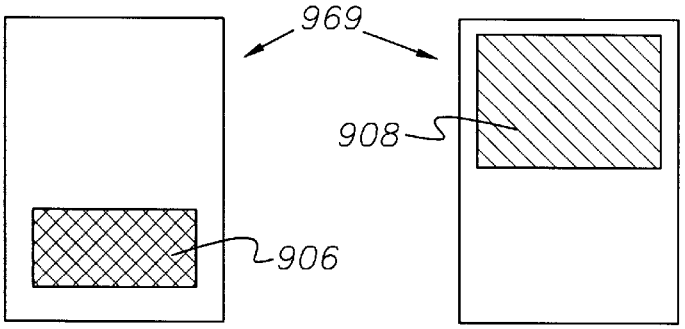
FIG. 21B FIG. 21C
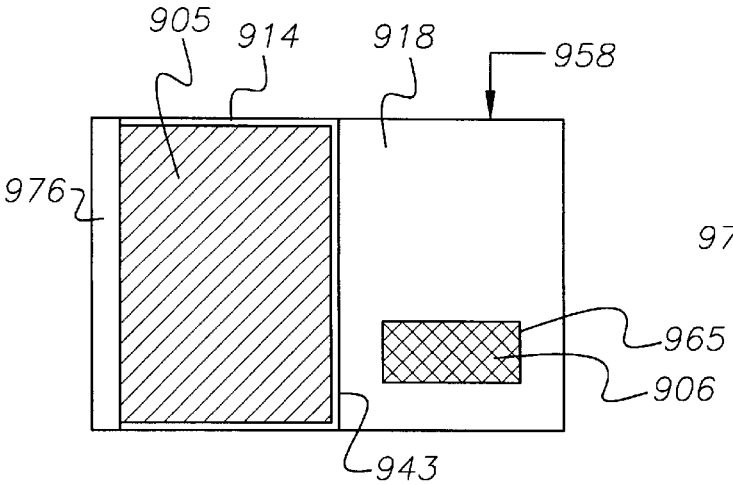
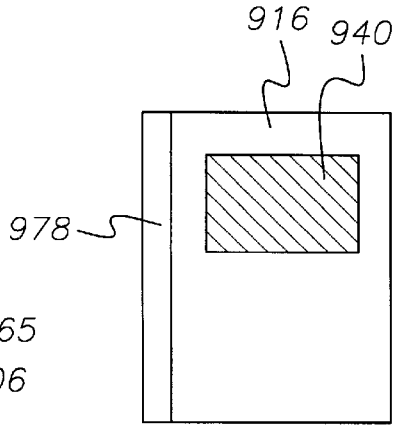
FIG. 21D FIG. 21E

REPORT COVER SYSTEM WITH TUCK CLOSURE

RELATED APPLICATION

This application claims the benefit of U.S. Provisional Application No. 60/028,650 filed Oct. 18, 1996.

FIELD OF THE INVENTION

The present invention relates to report cover systems. More particularly, the present invention relates to a new report cover system that provides the user with a convenient, integrated tuck closure device and a novel information layout where content on an inner face of the report cover or a report cover flap remains visible when the report cover is in the open position, and the report contents are viewed.

BACKGROUND OF THE INVENTION

There are a number of report cover systems of different designs and configurations known in the prior art. Examples of such designs can be found in any stationary store or catalog. While these devices fulfill their respective objectives and requirements, they do not describe or suggest a report cover system with an integrated tuck closure mechanism, wherein an edge of the front cover is tucked into a groove created by and between an inner face of a front cover strip and report contents secured thereto. Further, the devices of the prior art do not describe or suggest a report cover system wherein an inner face of the report cover and any text or materials thereon, or visible therethrough, remain visible to the user when the report cover is in the open position, and the pages of the report are turned. In this respect, the report cover system according to the present invention substantially departs from the conventional concepts and designs of the prior art, and in doing so provides a device primarily developed for the purpose of providing the user with a convenient and inexpensive report cover with a tuck closure feature and/or novel information layout. Therefore, it can be appreciated a need exists for new report cover system that provides a novel information layout and/or an integrated tuck closure for securing the front cover. In this regard, the present invention substantially fulfills these needs.

SUMMARY OF THE INVENTION

The new report cover system of the present invention provides an integrated tuck closure and a new information layout. More specifically, in one aspect the present invention provides a new report cover system that can be closed by tucking an edge of the front cover into a groove created by and between at least one front cover strip, or an extension therefrom, and report contents that are attached to a front cover strip. In another aspect, the present invention further provides a report cover system with a novel information layout where content on, or visible through, an inner face of the report cover (or an extension thereof) remains visible when the report is in the open position, and the user reviews pages of the report. In preferred form, the content on an inner face of the report cover (or an extension thereof) will be content that is visible through at least one face of the report cover (or an extension thereof). This novel layout is useful for placing such things as the table of contents for the report on or within an inner face of the report cover (or an extension thereof), where, when the report is in the open position, the table of contents remains visible throughout the time the user views the pages of the report.

More specifically, the present invention is a report cover system comprised of back cover means, a front cover and at least one front cover strip. The overall report cover may be made of any suitable pliable material, such as paper, paperboard, fiberboard, composition board, plastic, fabric, leather, and the like. The report cover(s) can be constructed of a single ply of suitable material, or may be constructed of two or more plys, as desired. Preferably, the front cover will be made of two ply material, with a pocket or space between the two plys. The report cover may be any suitable shape, but preferably is square or rectangular, with an upper edge, a lower edge, and lateral edges. The front report cover and the front cover strip are affixed to the back report cover means at locations opposite one another. Preferably, a back report cover comprises the back cover means, and both the front report cover and the front cover strip are affixed to the back cover at opposite edges of the back cover. Most preferably, the front cover, the back cover and the front cover strip are integrally formed from one sheet of suitable pliable material. Alternatively, the front cover strip may be secured directly to the top outer face of the report contents, while the back cover sheet may be secured to the bottom outer face of the report contents. In preferred form, there is a single cover strip, but two or more strips can be used as long as the front cover strip(s) are affixed to the back cover means, and include means for securing desired contents of a report to at least one face of a front cover strip. Alternatively, the front cover strip(s) may only include means for indicating where the user is to attach desired contents of a report to a front cover strip. In either situation, the securing or indicating means will be located on a front cover strip such that attachment of the report contents to a front cover strip creates a groove into which an edge of the front cover can be tucked. In this manner, an inexpensive and convenient means for securing the front cover of a report is provided.

Preferred embodiments of this invention are also of one-piece construction. Under these embodiments, one piece of suitable material is cut and folded such that a report cover system is created, comprising a front report cover, a back report cover, and a front cover strip. Other report cover systems, however, incorporating the teachings of this invention can be constructed. For example, the cover sheets and the front cover strip may be formed separately and subsequently attached to form the devices of this invention. Such attachment methods include adhesive, staples, or other mechanical attachment means. Similarly, unassembled report covers can be supplied to the user. Such report covers may include adhesive strips with peel-away backing. According to this embodiment, the user peels away the adhesive backing and assembles the report cover system.

The front cover strip of this invention may take many forms without departing from the teachings of the invention. In its simplest form, the front cover strip is a single strip comprised of a single layer of material, to which the report contents are affixed by any suitable means, such that attachment of the report contents to the front cover strip creates a groove by and between the outer face of the report contents and the inner face of the cover strip, into which an edge of the front cover can be tucked. In other forms, the front cover strip can be formed in a two-ply configuration. By way of example, a single layer of material can be folded along a vertical fold line to create inner and outer strips of the front cover strip. The report contents can then be attached to an inner strip of the front cover strip, or be attached through both the inner and outer strips of the front cover strip. Still further, portions of the front cover strip that are not used to attach content to the back cover means can be eliminated, thereby in effect, creating two or more separate cover strips. However, in any of these configurations, the desired groove is created by and between an inner face of the front cover strip(s) and report contents that are attached to the cover strip(s).

The report system of the present invention also provides a novel information layout where content on, or visible through, an inner face of a report cover (or an extension thereof) remains visible throughout the time the report contents are being viewed. This is especially useful when the content is on or visible through the inner face of the front cover, and the content is a table of contents, which is useful throughout the time the report is being read or referred to.

The means by which the desired report content is secured to the front cover strip may take many forms without departing from the present invention. By way of example, such attachment means may include a standard three hole punch configuration, wherein at least one front cover strip and the report contents have matching punch-outs. The user then secures the report contents to the front cover strip using a suitable fastener. Suitable fasteners include, but are not limited to, brass fasteners, prong fasteners, twin prong fasteners, and "Chicago" screws. The three-hole configuration on the front cover strip must be placed so as to allow a groove to be created by and between the inner face of the front cover strip and the attached report contents. Other suitable attachment means include stapling the desired contents to the front cover strip at locations marked on the front cover strip. Additionally, in some configurations, adhesive means can be used to secure the desired content to the front cover strip. Further, the attachment means can secure the report content to both the front cover strip and the back cover sheet. In any of these configurations, a groove is still created by and between the front cover strip and the report contents.

The more important features of the invention have thus been outlined, rather broadly, so that the following detailed description may be better understood, and in order that the present contribution to the art may be better appreciated. Additional features of the invention will be described below.

In this respect, before explaining preferred embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the invention, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

OBJECTS OF THE INVENTION

It is an object of the present invention to provide a new report cover system with an integrated tuck closure that secures the front cover.

It is another object of the present invention to provide a new report cover system wherein an inner face of the report cover and any text or other materials thereon, or visible therethrough, remains visible throughout the time the report is in the open position, no matter what content page is visible.

It is another object of the present invention to provide a new report cover system wherein an inner face of an extension attached to the report cover and any text or other materials on the inner face of the extension, or visible therethrough, remains visible throughout the time the report is in the open position, no matter what content page is visible.

It is yet another object of this invention to provide a report cover system that may be made of unitary construction.

It is another object of the present invention to provide a new report cover system that may be easily and efficiently manufactured and marketed.

It is a further object of the present invention to provide a new report cover system that is of durable and reliable construction.

An even further object of the present invention is to provide a report cover system that is susceptible of a low cost of manufacture with regard to both materials and labor, and which accordingly is then susceptible of low prices of sale to the consuming public, thereby making such a report cover system economically available to the buying public.

These together with other objects of the invention, along with the various features of novelty that characterize the invention, are pointed out with particularity in the claims annexed to this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 17A is a plan view of a sixth preferred embodiment in spread orientation; FIG. 17B is a plan view of a sixth preferred embodiment in an open orientation with report content therein; and, FIG. 17C is a front view of a sixth preferred embodiment of the report cover system constructed in accordance with the principles of the present invention.

FIG. 18A is a side view of a seventh preferred embodiment of the report cover system wherein the front cover strip further includes an integral tuck extension flap; and, FIG. 18B is a side view of a seventh preferred embodiment of the present invention wherein the tuck extension flap is separately formed from the front cover strip.

FIG. 20A is a plan view of a ninth preferred embodiment of the report cover system of present invention in a spread orientation; FIG. 20B is a front view of a ninth preferred embodiment of a closed report cover system constructed in accordance with the principles of the present invention; FIG. 20C is a side view of a report cover system constructed in accordance with the principles of the present invention, where a front cover flap is integrally attached to a front cover strip; and, FIG. 20D is a sectional side view of a ninth preferred report cover system of the present invention in an open configuration, where the front cover flap has been folded back.

FIGS. 21A, 21B, 21C, 21D, and 21E; FIG. 21A is a plan view of a tenth preferred embodiment of the report cover system of the present invention in a spread orientation; FIG. 21B is a front view of the first face of an insert sheet of the tenth preferred embodiment; FIG. 21C is a front view of the second face of an insert sheet of the tenth preferred embodiment; FIG. 21D is a plan view of a tenth preferred embodiment in an open orientation with report content therein; and, FIG. 21E is a front view of a tenth preferred embodiment of a closed report cover system constructed in accordance with the principles of the present invention.

FIG. 22A is a plan view of an eleventh preferred embodiment of the report cover system of the present invention in a spread orientation; FIG. 22B is a plan view of a eleventh preferred embodiment in an open orientation with report content therein; and, FIG. 22C is a front view of an eleventh preferred embodiment of a closed report cover system constructed in accordance with the principles of the present invention.

The same reference numerals refer to the same parts throughout the various Figures.

DESCRIPTION OF A FIRST PREFERRED EMBODIMENT

With reference now to the drawings, and in particular to FIGS. 1–6 thereof, a first preferred embodiment of the new report cover with tuck closure system embodying the principles and concepts of the present invention and generally designated by the reference number 10 will be described.

Specifically, it will be noted from the various Figures that the invention relates to a folio or report cover system where the user closes the report by tucking an edge of the front report cover into a groove created by and between the inner face of a front cover strip and the secured contents of the report. Further, the invention provides a front cover strip attachment formed of folded strips that conceals the means by which the report contents is secured to the folio. In its broadest context, the report cover system consists of a front cover, and a front cover strip, and back cover means (that is, a back cover unless the report contents are to function as a back cover for the report). In addition, from the various Figures it will also be noted that there is a novel information presentation aspect of the invention, namely the fact that an inner face of the report cover (or a sheet extending therefrom) remains visible when the report cover system is in the "open" position, thus allowing the report user to view content on an inner face of the cover (or extension) the entire time the report is being read or referred to.

Figure 1:
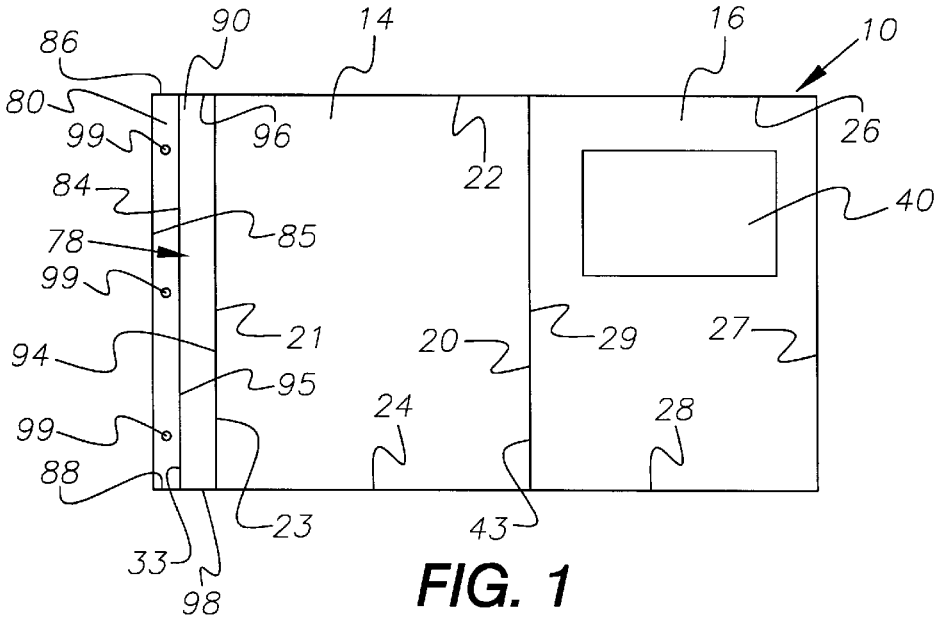
FIG. 1 is a plan view of a first preferred embodiment of the report cover system of the present invention in a spread orientation.
Figure 2:
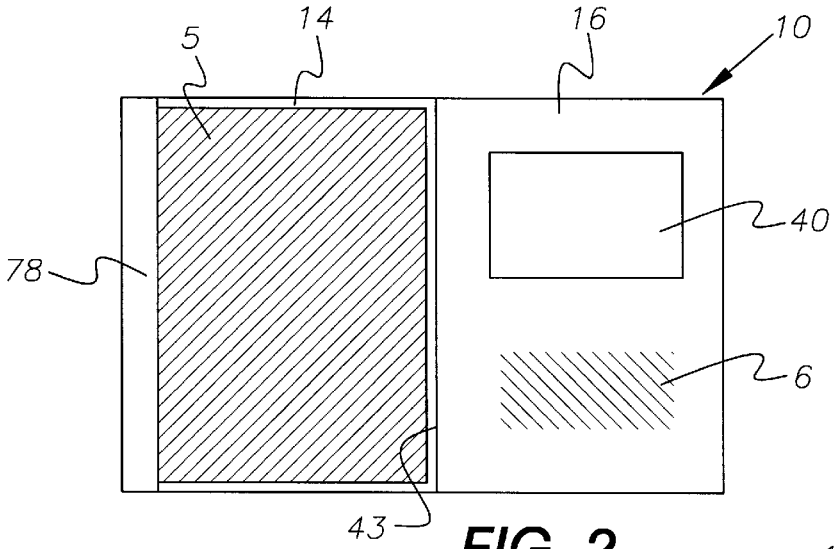
FIG. 2 is a plan view of a first preferred embodiment of the report cover system of the present invention in an open orientation, with report content therein.
Figure 3:
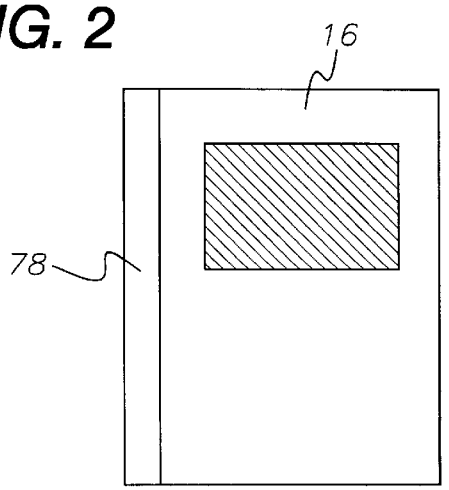
FIG. 3 is a front view of a first preferred embodiment of a closed report cover system constructed in accordance with the principles of the present invention.

More specifically, in the first preferred embodiment of the present invention is a system 10, as shown in FIGS. 1–6. The report cover of this first embodiment is preferably rectangular in configuration, as shown in FIG. 1. The report cover is formed of any suitable pliable material, preferably paperboard or plastic. Also preferably, the report cover system of this embodiment is of unitary or one-piece construction. Accordingly, suitable sheet material is cut and folded to form the integrated components of this embodiment. Specifically, the report cover system comprises a first rear or back cover sheet 14, a second front cover sheet 16, and a foldable vertical front cover strip 78 consisting of first outer front cover vertical strip 90 and second inner front cover vertical strip 80. Back cover sheet 14 has long vertical side edges 20 and 21. In preferred form back cover sheet 14 has a short upper edge 22 and a short lower edge 24.

Next, provided in system 10 of this embodiment is the report front cover strip 78. Report front cover strip 78 includes first outer front cover strip 90 and second inner front cover strip 80. Front cover strip 78 is also preferably rectangular in configuration. First outer front cover strip 90 has two long vertical side edges 94 and 95. Cover strip 78 may be formed separately from back cover sheet 14, but in preferred form, is formed integrally with it. Specifically, long vertical edge 94 of first outer front cover strip 90 is formed integrally with long vertical edge 21 of back cover sheet 14 along a first common joining or vertical fold line 23. First outer front cover strip 90 of front cover strip 78 further has a short upper edge 96 and a short lower edge 98.

Second inner front cover strip 80 of front cover strip 78 is also preferably rectangular in configuration, and has two long vertical side edges 84 and 85. Long vertical edge 84 is preferably formed integrally with long vertical edge 95 of first outer front cover strip 90 along a second common joining or vertical fold line 33. Second inner front cover strip 80 also has short upper edge 86 and short lower edge 88. Preferably, short upper edge 86 and short lower edge 88 are slightly shorter in length as compared with short upper edge 96 and short lower edge 98 of first outer front cover strip 90 to facilitate assembly of the report cover system. Second inner front cover strip 80 also includes holes 99 through which means for securing the desired contents of a report are placed. In this embodiment, the holes 99 are located in a standard "three-hole punch" configuration. Alternatively, second inner cover strip 80 may include attached fasteners for securing the desired contents.

Lastly provided in system 10 of this embodiment is the report front cover 16. Report front cover 16 may be formed separately from back cover 14, but in a preferred style, is formed integrally with it. Front cover 16 has long vertical side edges 27 and 29, a short upper edge 26 and a short lower edge 28. Long vertical edge 29 is formed integrally with long vertical edge 20 of back cover sheet 14 along a third common joining or vertical fold line 43. Both upper edge 26 and lower edge 28 must be of sufficient length to accommodate the overlap between front cover 16 and front cover strip 78 when the front cover 16 is folded back along vertical fold line 43, and tucked in under front strip 78. Report front cover 16 may also have at least one cutout section, which in this embodiment is shown as window opening 40. Further, the inner face of report front cover 16 may have text printed thereon or attached thereto, or visible therethrough. Such text might be, for example, a table of contents for the report. See FIG. 2. When the report cover system is opened, the printed text 6 remains visible on the inner face of the report front cover 16 throughout the time the user turns the content pages 5 of the report. See FIG. 2. Additionally, the inner face of report front cover 16 may have a pouch pocket (not shown) for the receipt of supplemental material(s).

Figure 4:
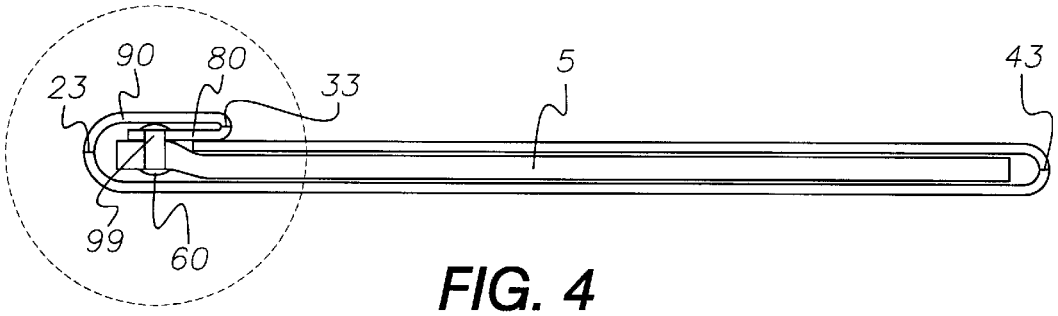
FIG. 4 is a side view of a report cover system constructed in accordance with the principles of the present invention, where the front cover strip is formed of two layers of pliable material, and where the front cover strip is formed integrally with the report cover.
Figure 5:
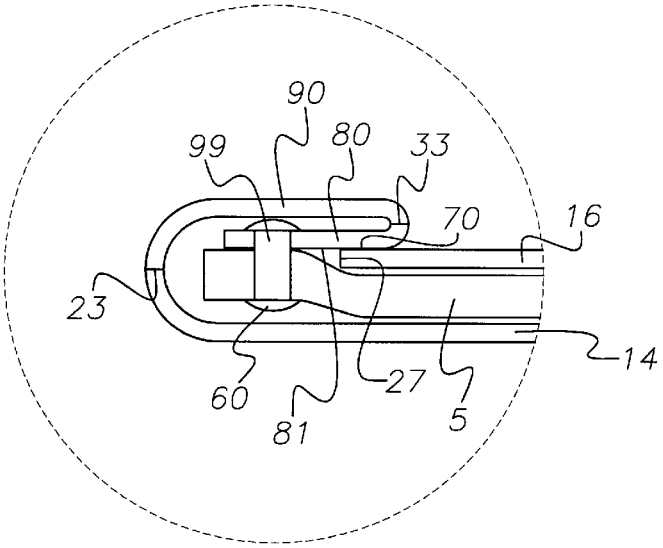
FIG. 5 is a partial view of a first preferred report cover tuck closure device of the present invention, where the front cover strip is constructed of two layers of pliable material, and where the front cover strip is formed integrally with the report cover.
Figure 6:
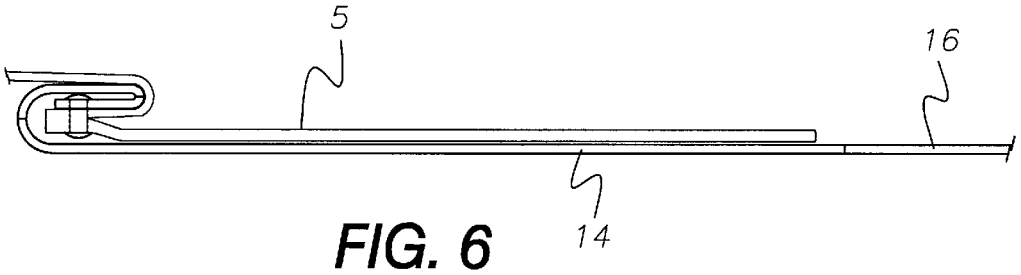
FIG. 6 is a sectional side view of a first preferred report cover system of the present invention in an open configuration, where a portion of the report contents has been folded back and the inner face of the report front cover remains visible to the user.

To enclose desired content in the report cover system of this embodiment, the user secures report content 5, as shown in FIGS. 4 and 5, to the front cover strip 78. Preferably this is done by securing report content 5 to the outer portion of second inner strip 80 of front cover strip 78 so that the outer face of the first page of the report content is in contact with the outer portion of second inner front cover strip 80 of front cover strip 78. The report content is secured by any suitable means, such as with prong fasteners 60 which extend through holes 99 in second inner strip 80 of front cover strip 78 and the three-hole punched report contents. Preferably, second inner front cover strip 80 is pre-folded by the manufacturer along vertical fold line 33 over first outer front cover strip 90. Alternatively, the user folds second inner strip 80 of front cover strip 78, along vertical fold line 33, over first outer front cover strip 90. Next, both second inner strip 80 and first outer strip 90 of front cover strip 78 are folded along vertical fold line 23 such that report contents 5 are secured within cover strip 78, and rest atop back cover sheet 14, in a "book like" configuration. See FIGS. 4 and 5. To effect closure of report cover system 10, the user folds report front cover 16 along vertical fold line 43 and tucks long vertical edge 27 of report front cover 16 into groove 70 formed by and between outer face 81 of inner front cover strip 80 (which is now folded inwardly), and contents 5 of the report. See FIGS. 4 and 5.

Additionally, if desired, the user may employ "Chicago" screws or brass fasteners to secure report contents 5 to the front cover strip 78. In this embodiment (not shown), the Chicago screws or brass fasteners extend through first outer front cover strip 90, second inner front cover strip 80, report contents 5, and back cover sheet 14, thus providing a means for securing even more content in the report.

DESCRIPTION OF A SECOND PREFERRED EMBODIMENT

Figure 8:
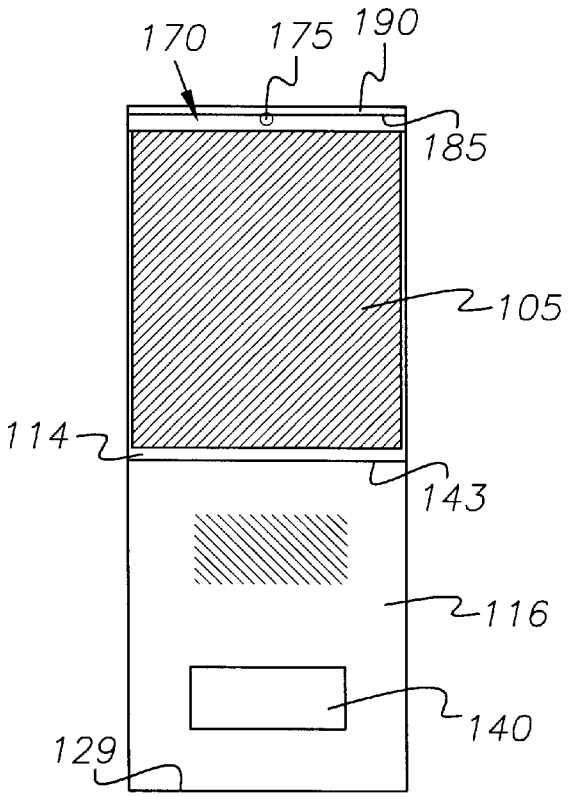
FIG. 8 is a plan view of a second preferred embodiment of the report cover system of the present invention in an open orientation with report content therein.
Figure 7:
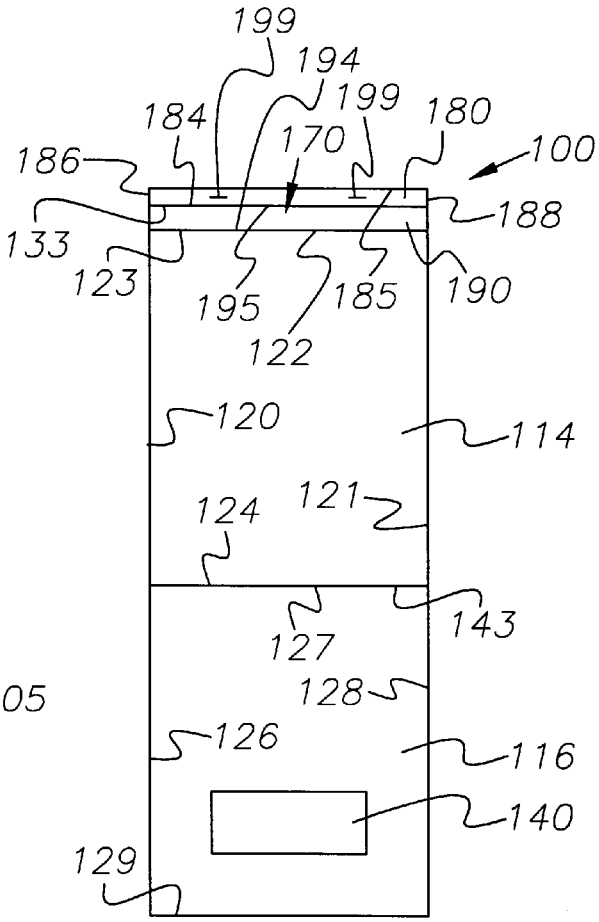
FIG. 7 is a plan view of a second preferred embodiment of the report cover system of the present invention in a spread orientation.
Figure 9:
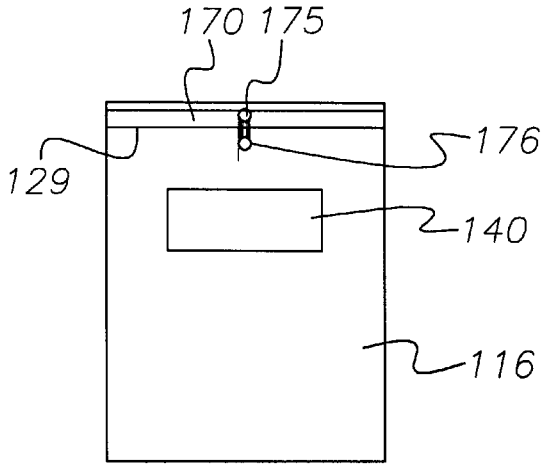
FIG. 9 is a front view of a second preferred embodiment of the report cover system constructed in accordance with the principles of the present invention.
Figure 10:
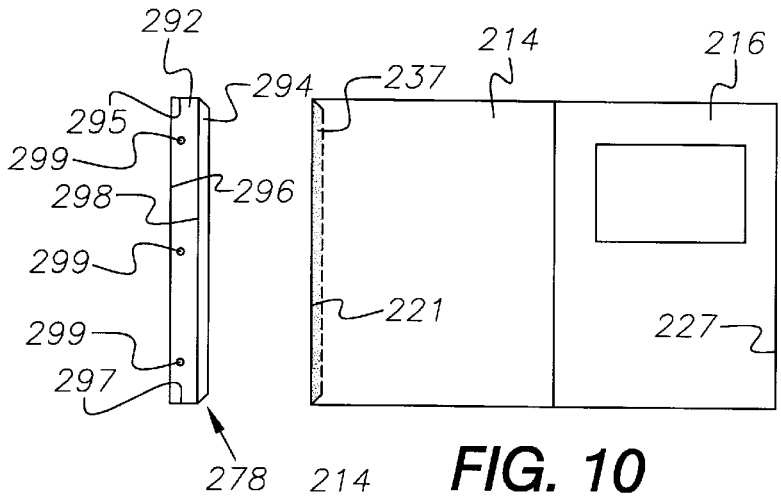
FIG. 10 is a plan view of a third preferred embodiment of the report cover system of the present invention in a spread orientation.
Figure 11:
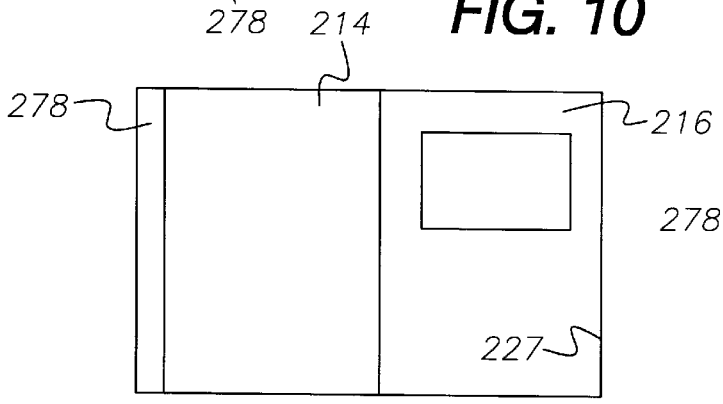
FIG. 11 is a plan view of a third preferred embodiment of the report cover system of the present invention in an open orientation.
Figure 12:
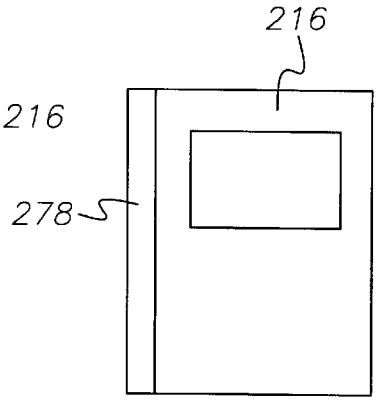
FIG. 12 is a front view of a third preferred embodiment of the report cover system constructed in accordance with the principles of the present invention.
Figure 13:
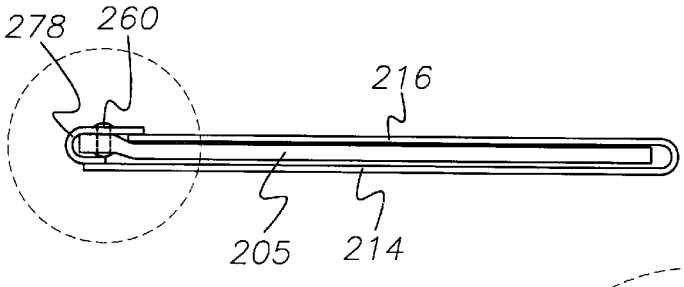
FIG. 13 is a side view of a report cover system constructed in accordance with the principles of the present invention, where the front cover strip is constructed of a single layer of pliable material, and where the front cover strip is formed separately from, and later attached to, the report cover.
Figure 14:
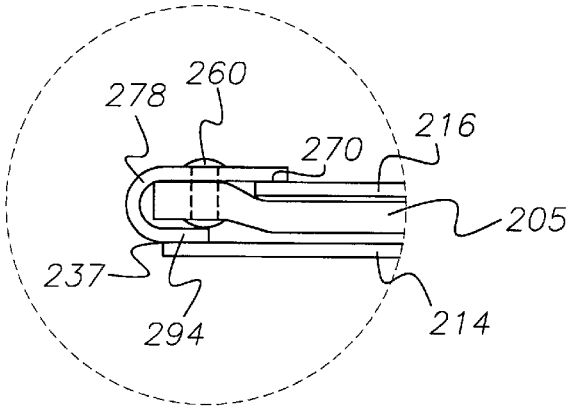
FIG. 14 is a partial view of a second preferred tuck closure device of the present invention, where the front cover strip is constructed of a single layer of pliable material, and where the front cover strip is formed separately from, and later attached to, the report cover.

In a second preferred embodiment, the report cover opens and closes in a vertical direction as opposed to the horizontal direction described in the first embodiment. The report cover system of the second embodiment may incorporate the tuck closure aspect of the present invention, but in this embodiment, incorporates a conventional report cover securing means, namely, a string-button mechanism. See FIG. 9. Further, the second embodiment employs alternate means for securing the desired report content, namely ordinary paper staples. The second preferred embodiment is shown in FIGS. 7–9.

System 100 of the second preferred embodiment is formed in part of a first back cover sheet 114, a second front cover sheet 116, a front cover strip 170 having a first outer strip 190 and a second inner strip 180. Back cover sheet 114 has long vertical side edges 120 and 121. In preferred form back cover sheet 114 has a short upper edge 122 and a short lower edge 124.

Next provided in system 100 of this embodiment is the report cover strip's first and second strips, 190 and 180, respectively. Front cover strip 170 is also preferably rectangular in configuration. First outer strip 190 of front cover strip 170 has long lower edge 194 and long upper edge 195. Referring to FIG. 8, first outer strip 190 also has button 175 attached thereto by any suitable means. Front cover strip 170 may be formed separately from back cover sheet 114, but in preferred form, is formed integrally with it. Specifically, long lower edge 194 is formed integrally with upper edge 122 of back cover sheet 114 along a first common joining or horizontal fold line 123. See FIG. 7.

Second inner strip 180 of front cover strip 170 has two short vertical edges 186 and 188, a long lower edge 184 and long upper edge 185. Long lower edge 184 is formed integrally with long upper edge 195 of first outer strip 190 of front cover strip 170 along a second common joining or horizontal fold line 133. Second inner strip 180 also has means 199 for indicating where the user is to secure the desired contents of a report. In this embodiment, the indicating means comprise two printed marks 199 that indicate where the user is to staple the desired contents of the report. Indicating means 199 can also comprise indentations stamped into second inner strip 180, of front cover strip 170. See FIG. 7.

Lastly provided in system 100 of this embodiment is the report front cover 116. Report front cover 116 may be formed separately from back cover 114, but in a preferred style, is formed integrally with it. Front cover 116 has short upper edge 127 and a short lower edge 129. It also has long vertical side edges 126 and 128. Short upper edge 127 is preferably formed integrally with short lower edge 124 of back cover sheet 114 along a third common joining or horizontal fold line 143. See FIG. 7.

As shown in FIG. 9, report front cover 116 also has button 176 attached thereto by any suitable means. Button 176 is located with respect to button 175 such that a standard string-button mechanism may be formed. Button 176 also has string attached thereto. Report front cover 116 may also have at least one cutout section, which in this embodiment is shown as window opening 140.

To enclose desired content in the report cover system of this second embodiment, the user secures the report contents to the front cover strip. Preferably this is done by securing report content 105 to the outer portion of second inner strip 180 of front cover strip 170 so that the outer face of the first page of the report content is in contact with the outer portion of second inner front cover strip 180. The report content is secured to the front cover strip with ordinary staples in the marked locations. Next, the user folds inner strip 180 over outer strip 190 along fold line 133. The user then folds both first and second strips 180 and 190 over back cover sheet 114 along fold line 123. Finally, the user closes the cover system by folding the report front cover upwardly and wrapping the string around the two buttons 175 and 176.

DESCRIPTION OF A THIRD PREFERRED EMBODIMENT

The third preferred embodiment operates in much the same way as the first preferred embodiment. The differences include a front cover strip that is not integrally formed with the back cover, and is not formed of folded portions designed to hide the means by which the report content is secured to the front cover strip. Otherwise, the first and third preferred embodiments are substantially the same. Accordingly, only the new or different features, namely the front cover strip of the third embodiment, will be discussed.

Referring to FIGS. 10–14, front cover strip 278 is formed of a long vertical strip 292 and a lateral flap 294. Long vertical strip 292 has two long vertical edges 296 and 298, a short upper edge 295 and a short lower edge 297. Lateral flap 294 extends laterally from long vertical strip 292 along vertical edge 298. Lateral flap 294 is adapted to be folded along vertical edge 298. Lateral flap 294 is then coupled to back cover 214 along vertical edge 221 with any suitable attachment means, such as glue, adhesive strips, staples, brass fasteners, and the like. The attachment means of this embodiment is adhesive glue 237.

To enclose a report, the user secures the outer face of the report contents to the inner face of vertical strip 292 of front cover strip 278 using brass fasteners 260. The front cover strip is folded along vertical edge 298 such that the report contents now rest on the inner face of the back cover. To secure the front cover 216, the user simply tucks long vertical edge 227 of the front cover 216 into the groove 270 created by and between the report contents 205 and the inner face of front cover strip 278.

DESCRIPTION OF A FOURTH PREFERRED EMBODIMENT

Figure 15:
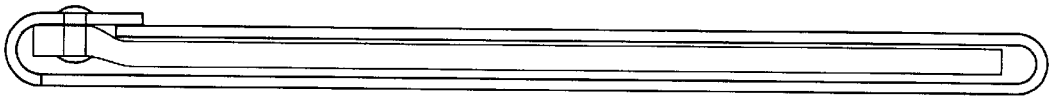
FIG. 15 is a side view of a fourth preferred embodiment wherein the front cover strip is formed integrally with the back cover sheet.

FIG. 15 shows a fourth preferred embodiment of the present invention. The fourth preferred embodiment differs from the third preferred embodiment in one respect. Namely, the front cover strip of the fourth preferred embodiment is integrally formed with the back cover sheet, and then folded as needed to create the report cover system. Otherwise, the third and fourth embodiments are substantially identical in components, construction and assembly.

DESCRIPTION OF A FIFTH PREFERRED EMBODIMENT

Figure 16:
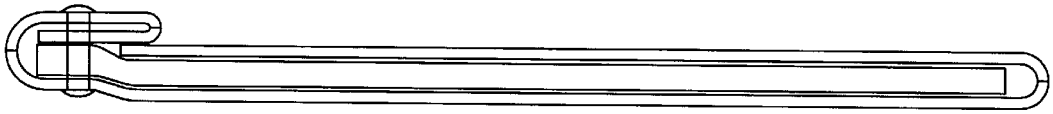
FIG. 16 is a side view of a fifth preferred embodiment wherein the report content is secured to both the front cover strip and the back cover sheet.

As shown in FIG. 16, a fifth preferred embodiment of this invention provides a report cover with tuck closure wherein the fastener securing the report contents extends through the front cover strip, the report contents and the back cover sheet. Accordingly, the back cover sheet has holes in a three-hole punch configuration corresponding to the holes in the front cover strip. The fasteners simply extend through and abut against the outer face of the back cover sheet. This configuration provides additional support to the fastener for holding more report content. Otherwise, the fifth preferred embodiment is substantially identical to the first preferred embodiment. Accordingly, reference should be had to the disclosure of the first preferred embodiment for assembly.

DESCRIPTION OF A SIXTH PREFERRED EMBODIMENT

Figure 17A:
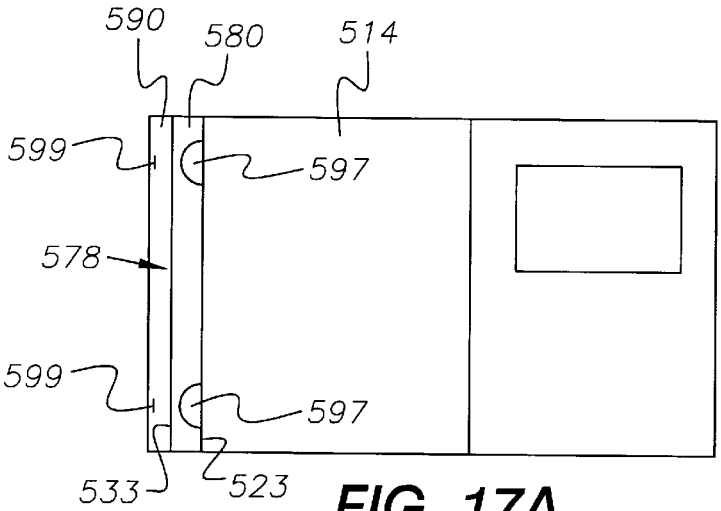
FIGS. 17A, 17B and 17C.
Figure 17B:
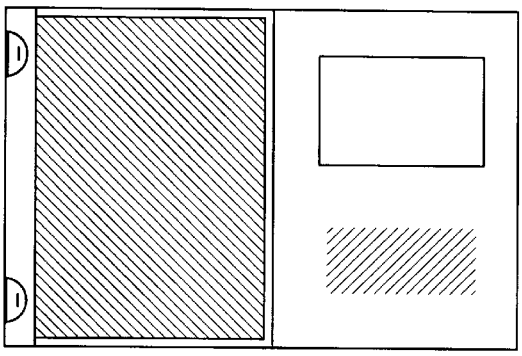
Figure 17C:
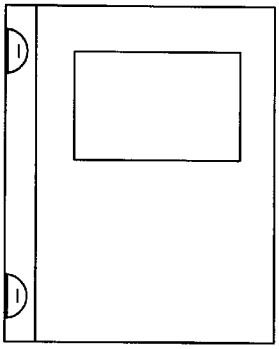

A sixth preferred embodiment is shown in FIGS. 17A–17C. The sixth preferred embodiment is substantially the same as the first preferred embodiment, except that the sixth preferred embodiment has a front cover strip with die-cut openings corresponding to the locations where the user attaches the report content to the inner front cover strip through to the back cover.

More particularly, front cover strip 578 has inner front cover strip 580 and outer front cover strip 590. Inner front cover strip 580 has means 599 to indicate where the user is to staple or otherwise secure the desired contents of a report. In this embodiment, the indicating means 599 comprise two printed marks that indicate where the user is to staple the desired report contents.

Outer front cover strip 590 has die-cut openings 597 corresponding to the locations of indicating means 599 of inner front cover strip 580. Die-cut openings 597 provide the user with the option of securing the report contents by a slightly different method than previously disclosed. Particularly, the user folds inner front cover strip 580 along vertical fold line 533 and over outer front cover strip 590. Next, both inner front cover strip 580 and outer front cover strip 590 are folded along vertical fold line 523 such that the indicating means 599 of inner front cover strip 580 are visible through die cut openings 597 of outer front cover strip 590. The user then places the desired report content under inner front cover strip 580 and against vertical fold line 523. The user then staples the desired report contents through both inner front cover strip 580 and back cover sheet 514.

The remaining components, construction and assembly of the sixth preferred embodiment are substantially identical to the first preferred embodiment. Accordingly, reference should be had to the discussion of the first preferred embodiment, as such disclosure will not be repeated herein.

DESCRIPTION OF A SEVENTH PREFERRED EMBODIMENT

Figure 18A:
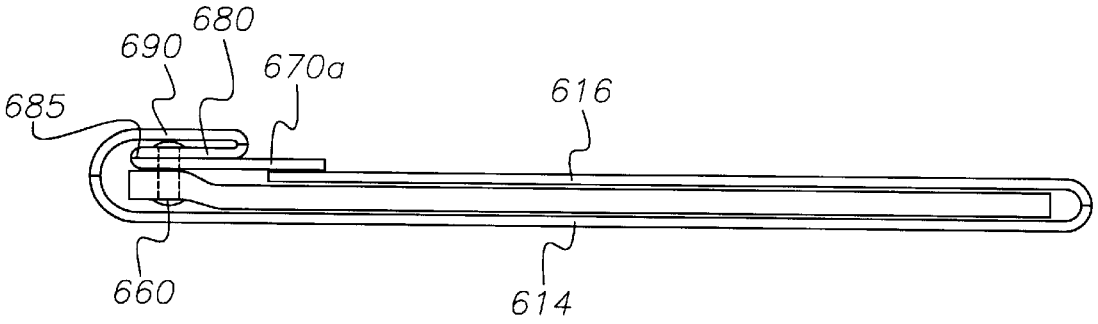
FIGS. 18A and 18B.
Figure 18B:
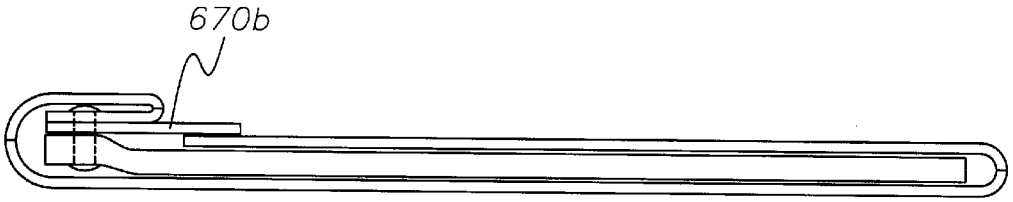

A seventh preferred embodiment is shown in FIGS. 18A and 18B. The seventh preferred embodiment features an additional tuck extension flap attached to and forming part of the front cover strip. As shown in FIGS. 18A and 18B, the tuck extension flap can be either separately or integrally formed to vertical edge 685 of inner front cover strip 680. Thus, the seventh preferred embodiment provides an extra-wide front cover strip with enhanced strength and durability due to the two-ply configuration between the fastener 660 and the report contents 605.

More particularly, front cover strip comprises outer front cover strip 690, inner front cover strip 680, and tuck extension flap 670*a* and 670*b*. Tuck extension flap 670*a* and 670*b* can be formed separately from inner front cover strip 680 (see FIG. 18B), but in preferred style, is formed integrally with it (see FIG. 18A). Tuck extension flap 670*a* and 670*b* also has holes (not shown) in a three-hole punch configuration corresponding to the holes in inner front cover strip 680.

The width of tuck extension flap 670*a* or 670*b* may be configured to cover at least half of the front cover of the report, and may further include a window therethrough (not shown), or information printed thereon. In such an embodiment having an extended width tuck extension flap, the width of the front cover would accordingly be decreased to tuck under the extension flap.

To assemble the report system of this embodiment where the tuck extension flap is integral with inner front cover strip 680, the user folds tuck extension flap 670*a* under inner front cover strip 680. The user then attaches the desired report contents through both inner front cover strip 680 and tuck extension flap 670*a*. Next, both inner front cover strip 680 and tuck extension flap 670*a* are folded over outer front cover strip 690. Then, all three strips and the report contents are folded over back cover sheet 614 as shown in FIG. 18A. The user then closes the report by tucking an edge of the front cover in the groove created by and between the tuck extension flap and the report contents.

Referring to FIG. 18B, where the tuck extension flap is formed separately from the front cover strip, the user assembles the report cover almost identically to the first embodiment. The user simply places the tuck extension flap 670*b* on top of the report contents along the left vertical edge and secures both the tuck extension flap 670*b* and the report contents to inner front cover strip 680. The user then assembles the report cover system as disclosed in the description of the first embodiment. In this manner, the tuck extension flap provides a feature under which an edge of the front cover can be tucked.

The remaining components, features and assembly of the seventh preferred embodiment are identical to the first preferred embodiment. It follows that reference should be had to the description of the first preferred embodiment, as such description will not be repeated here.

DESCRIPTION OF AN EIGHTH PREFERRED EMBODIMENT

Figure 19:
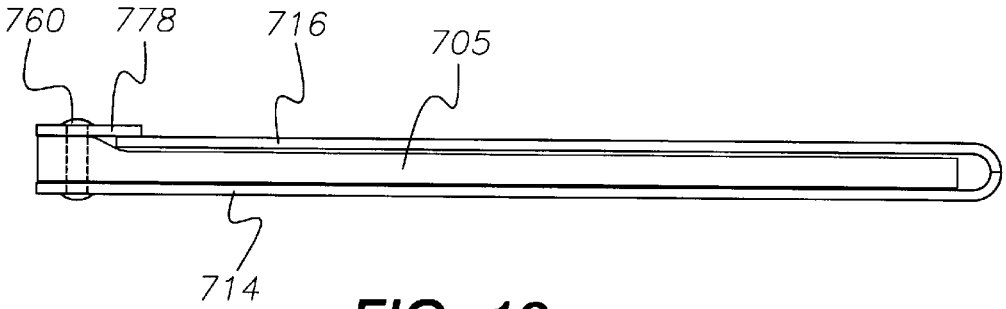
FIG. 19 is a side view of an eighth preferred embodiment wherein the front cover strip attaches to the report content, but remains separate from the back cover sheet.

As shown in FIG. 19, an eighth preferred embodiment of the present invention provides a report cover system wherein the front cover strip remains unattached to the back cover sheet after assembly of the report.

Front cover strip 778 again has holes arranged in a three-hole punch configuration therethrough. Similarly, back cover sheet 714 has holes corresponding to the three hole punch configuration of front cover strip 778. To effect the tuck closure feature, fasteners 760 secure together front cover strip 778, report contents 705, and back cover sheet 714. See FIG. 19. Otherwise, the report cover system of the eighth preferred embodiment is substantially the same as the first preferred embodiment.

DESCRIPTION OF A NINTH PREFERRED EMBODIMENT

FIGS. 20A–20D disclose a ninth preferred embodiment of the present invention. The ninth preferred embodiment features a front cover flap that is attached to the front cover strip and folds over the front cover. Alternatively, but not shown, the front cover flap may be attached to the back cover sheet and folded to cover the front cover strip and the front cover. Further, the front cover flap may have fastening means to secure the front cover flap to the front cover by any suitable means, which in this embodiment is shown as a string-button mechanism. This configuration achieves a report cover system wherein the front cover is secured by both a tuck closure device and a front cover flap. Otherwise, the ninth preferred embodiment is substantially the same as other preferred embodiments. Accordingly, only the different components and assembly of the ninth preferred embodiment will be discussed.

Specifically, provided in this embodiment is the report front cover strip 878 and front cover flap 880. Front cover strip 878 is also preferably rectangular in configuration. Front cover strip 878 has two long vertical side edges 894 and 895. Cover strip 878 may be formed separately from back cover sheet 814, but in preferred form, is formed integrally with it. Specifically, long vertical edge 894 of front cover strip 878 is formed integrally with long vertical edge 821 of back cover sheet 814 along a first common joining or vertical fold line 823. Front cover strip 878 also includes holes 899 through which means for securing the desired contents of a report are placed. In this embodiment, the holes 899 are located in a standard "three-hole punch" configuration. Alternatively, front cover strip 878 may include attached fasteners for securing the desired contents.

Figure 20A:
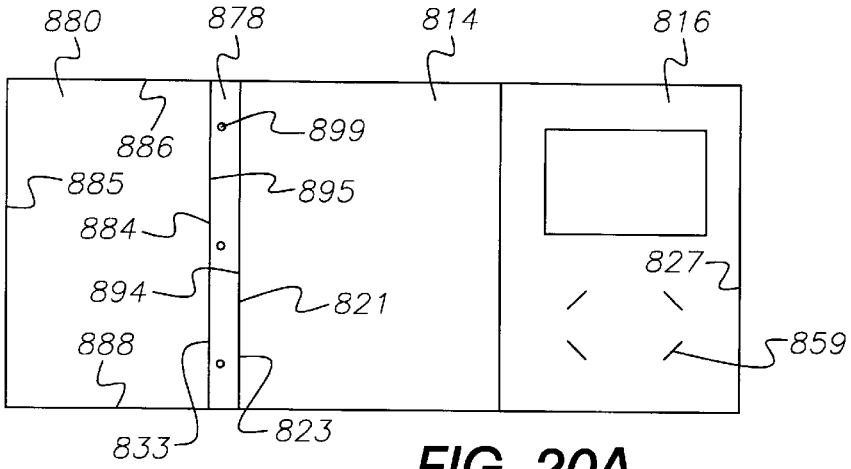
FIGS. 20A, 20B, 20C, and 20D.
Figure 20B:
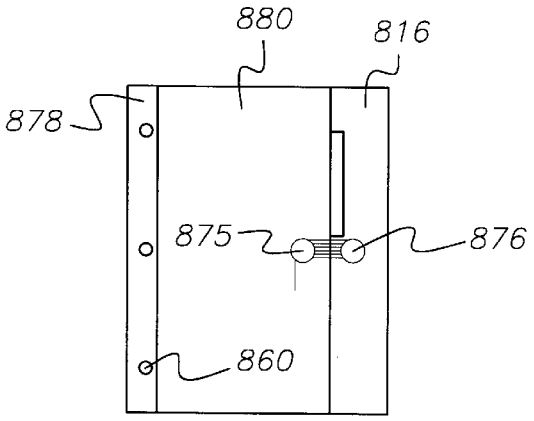
Figure 20C:
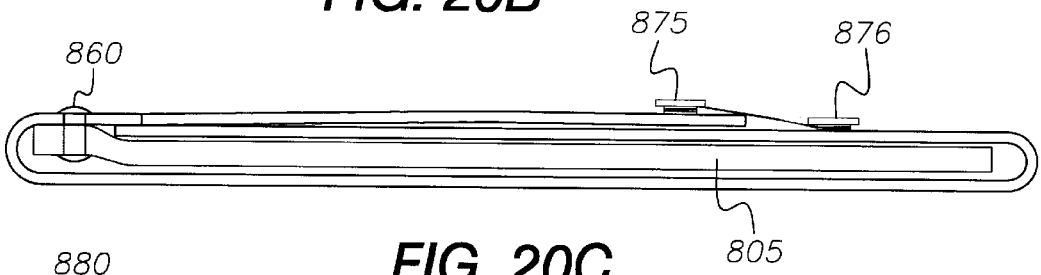
Figure 20D:
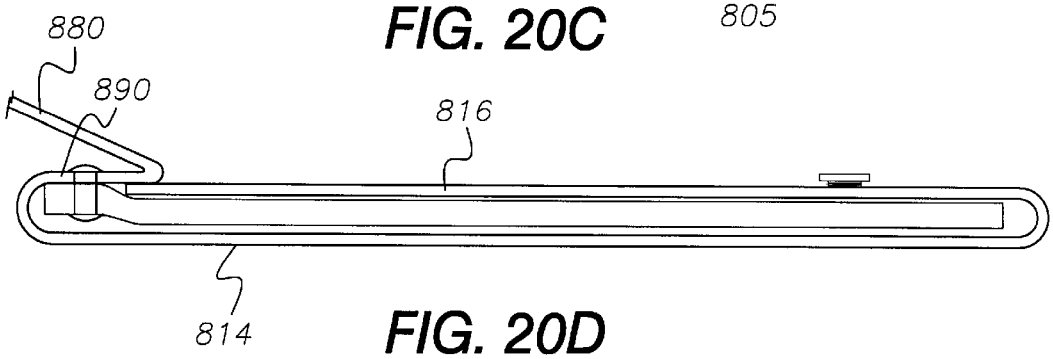

Front cover flap 880 is also preferably rectangular in configuration, and has two long vertical side edges 884 and 885. Long vertical edge 884 is preferably formed integrally with long vertical edge 895 of front cover strip 878 along a second common joining or vertical fold line 833. Referring to FIG. 20B, front cover flap 880 also has button 875 attached thereto by any suitable means. Front cover flap 880 may also be formed separately from front cover strip 878 without departing from the scope and spirit of the invention (not shown).

As shown in FIG. 20B, report front cover 816 also has button 876 attached thereto by any suitable means. Button 876 is located with respect to button 875 such that a standard string-button mechanism may be formed. Button 876 also has string attached thereto. Report front cover 816 also has means to secure a business card or other materials thereto. Specifically, front cover 816 has four slits 859 into which the four corners of a business card are placed.

The remaining components, construction and assembly of the ninth preferred embodiment is substantially identical to the first preferred embodiment. Accordingly, reference should be had to the discussion of the first preferred embodiment as such disclosure will not be repeated herein.

To enclose desired content in the report cover system of this ninth embodiment, the user secures the report contents to the front cover strip. Preferably this is done by securing report content 805 to the inner face of front cover strip 878 so that the outer face of the first page of the report content is in contact with the inner portion of front cover strip 878. The report content is secured to the front cover strip with ordinary brass fasteners 860 in the marked locations 899. Next, the user folds front cover strip 878 over back cover sheet 814 along fold line 823. The user then folds front cover sheet 816 over back cover sheet 814 and tucks vertical edge 827 of front cover sheet in the groove created by and between front cover strip 878 and the attached report contents. Finally, the user closes the cover system by folding the front cover flap 880 over the front cover sheet and wrapping the string around the two buttons 875 and 876.

DESCRIPTION OF A TENTH PREFERRED EMBODIMENT

The tenth preferred embodiment features a front cover having a pocket with an open upper edge for the receipt of at least one customizing insert sheet. Such a pocket may also be formed into an additional cover extending along an edge of the front cover (not shown). The pocket in this embodiment is formed by a first outer cover sheet and a second inner backing sheet coupled together to define a pocket. Furthermore, in this embodiment, both the outer cover sheet and inner backing sheet have cutout sections therein through which the insert sheet and any text, graphics or other material thereon can be viewed. (Alternatively, but not shown, only one of the outer cover sheet, or the inner backing sheet, but not both, will have cutout section(s) therein.) Otherwise, the tenth preferred embodiment is substantially the same as the first preferred embodiment. Accordingly, only the different components and assembly details of the tenth preferred embodiment will be discussed below.

Specifically, as shown in FIGS. 21A–21E, the report front cover has a pocket with an open upper edge defined by first outer cover sheet 916 and second inner backing sheet 918. Report front cover sheet 916 may be formed separately from back cover 914, but in a preferred style, is formed integrally with it. Outer front cover sheet 916 has long vertical side edges 927 and 929, a short upper edge 926 and a short lower edge 928. Long vertical edge 929 is formed integrally with long vertical edge 920 of back cover sheet 914 along a common joining or vertical fold line 943. Additionally, outer cover sheet 916 may have at least one cutout opening therein through which an insert sheet and attached materials may be viewed, which in this embodiment is shown as large window opening 940.

Next, provided in this embodiment is inner backing sheet 918. Inner backing sheet 918 has short upper edge 952 and short lower edge 954. Inner backing sheet 918 also has long vertical edges 950 and 951. Inner backing sheet also has cutout section 965 therein. Inner backing sheet 918 may be formed separately from outer front cover sheet 916, but in preferred style is formed integrally with it. Long vertical edge 951 is formed integrally with long vertical edge 927 of outer front cover sheet 916 along a second common joining or vertical fold line 956. Inner backing sheet 918 also has lateral flap 953 extending laterally from long vertical edge 950. Inner backing sheet 918 further has bottom flap 955 extending downwardly from lower edge 954. To assemble the pocket 958, lateral flap 953 is adapted to be folded in and bottom flap 955 is adapted to be folded up. Next, inner backing sheet 918 is folded over outer front cover sheet 916. Adhesive 957 couples lateral flap 953 and bottom flap 955 to front cover sheet 916 to thereby form pocket 958 with an opening at the upper edge.

Lastly, provided in this embodiment is insert sheet 969. Such insert sheet is positionable within pocket 958. The insert sheet may be provided with the folio, or may be provided separately. As shown in FIG. 21B, a first face of insert sheet 969 has a first region 906 of a first optical characteristic positionable behind cutout window 965 of inner backing sheet 918. As shown in FIG. 21C, a second face of insert sheet 969 may also have a second region 908 of a second optical characteristic positionable behind cutout window opening 940 of outer front cover sheet 916. The optical characteristics of insert sheet 969 allow the report cover system to take on different visual looks. Additionally, region 906 may include text, such as a table of contents printed on, or added to, the insert sheet. When the report cover is in the open position, this text in region 906 remains visible to the user through cutout opening 965 in inner backing sheet 918, as the user reads or refers to the report contents 905. See FIG. 21D.

The preferable fabrication of insert sheet 969 is a sheet of laser printable paper with different optical characteristics on opposing faces of the sheet. The optical characteristics of insert sheet 969 can include, but are not limited to, color, texture, text, and/or graphics. Insert sheet 969 is placed within pocket 958 between outer front cover sheet 916 and inner backing sheet 918 with the optical characteristics aligned with the cutout openings in outer front cover sheet 916 and inner backing sheet 918 to allow the optical characteristics of the insert sheet to be viewed through the cutout openings in the outer cover sheet and the inner backing sheet. If desired, insert sheet 969 may include adhesive means (not shown), for example in the area of the upper corners, for securing insert sheet 969 to the inner face of front cover sheet 916 in pocket 958.

It should be noted, however that upper edge 926, lower edge 928, upper edge 952, and lower edge 954 must all be of sufficient length to accommodate the overlap between front cover 916 and front cover strip 978 when the front cover 916 is folded back along vertical fold line 943, and tucked in under front strip 978. Otherwise, the remaining components, construction, and assembly of the tenth preferred embodiment is substantially the same as the first preferred embodiment. Accordingly, reference should be had to the description of the first preferred embodiment as such will not be repeated herein.

DESCRIPTION OF AN ELEVENTH PREFERRED EMBODIMENT

In an eleventh preferred embodiment, the report cover attaches to a lateral edge of the back cover and opens and closes in a horizontal direction as opposed to the vertical direction as described in the second embodiment. The report contents, however, attaches to a front cover strip that is attached to the upper horizontal edge of the back cover. Thus, the report front cover locks into a front cover strip at its upper edge. The eleventh preferred embodiment is shown in FIGS. 22A–C.

Figure 22A:
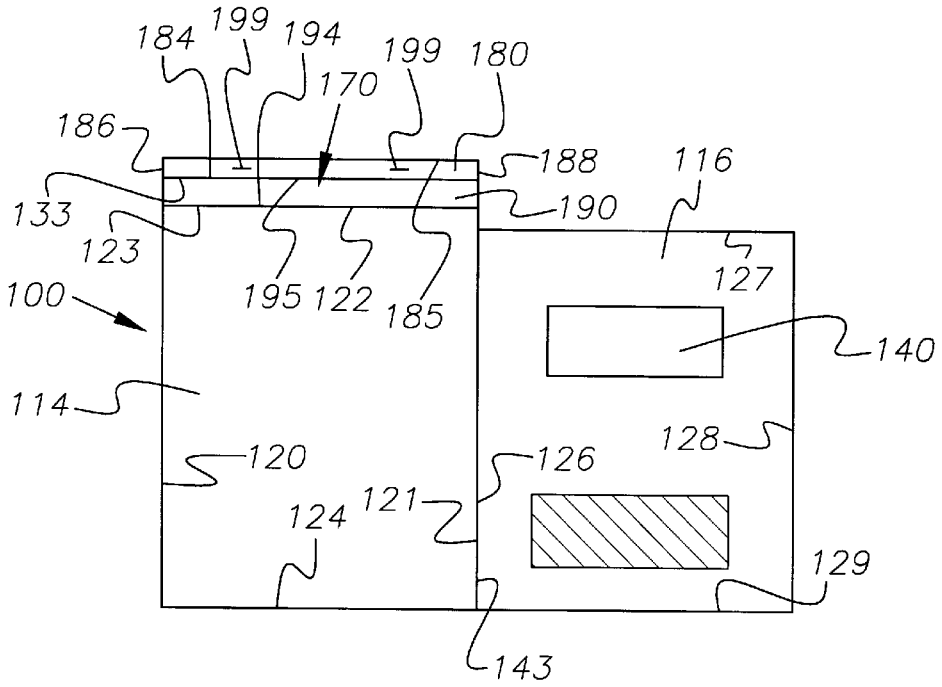
FIGS. 22A, 22B, and 22C.
Figure 22B:
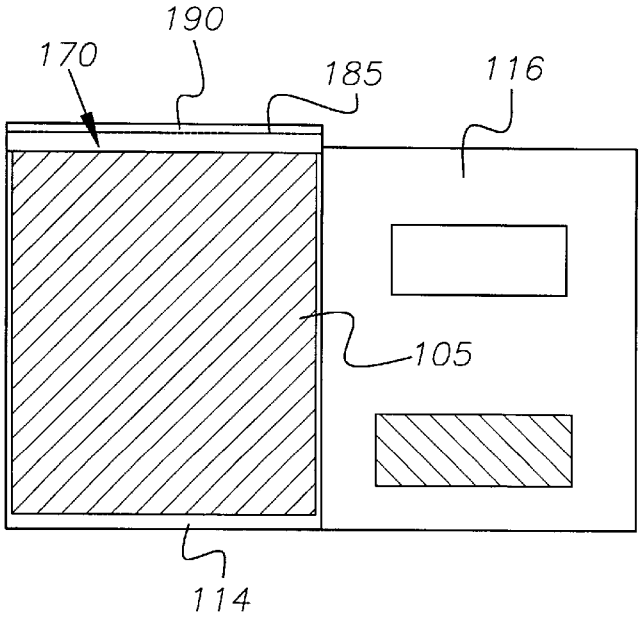
Figure 22C:
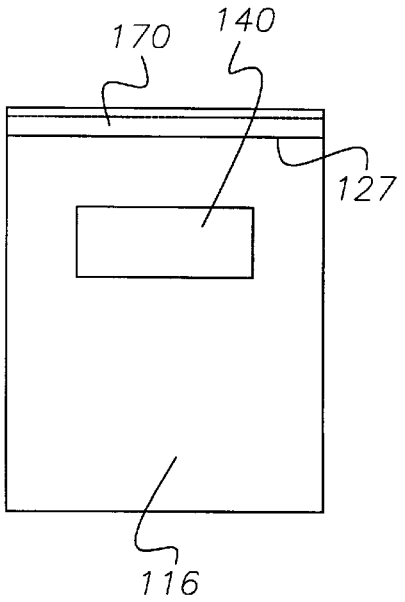

Referring to FIG. 22A, system 100 of the eleventh preferred embodiment is formed in part of a first back cover sheet 114, a second front cover sheet 116, a front cover strip 170 having a first outer strip 190 and a second inner strip 180. Back cover sheet 114 has long vertical side edges 120 and 121. In preferred form back cover sheet 114 has a short upper edge 122 and a short lower edge 124.

Next provided in system 100 of this embodiment is the report front cover strip 170 comprising first and second cover strips, 190 and 180, respectively. Front cover strip 170 is also preferably rectangular in configuration. First outer strip 190 of front cover strip 170 has long lower edge 194 and long upper edge 195. Front cover strip 170 may be formed separately from back cover sheet 114, but in preferred form, is formed integrally with it. Specifically, long lower edge 194 is formed integrally with upper edge 122 of back cover sheet 114 along a first common joining or horizontal fold line 123. See FIG. 22A.

Second inner strip 180 of front cover strip 170 has two short vertical edges 186 and 188, a long lower edge 184 and long upper edge 185. Long lower edge 184 is formed integrally with long upper edge 195 of first outer strip 190 of front cover strip 170 along a second common joining or horizontal fold line 133. Second inner strip 180 also has means 199 for indicating where the user is to secure the desired contents of a report. In this embodiment, the indicating means comprise two printed marks 199 that indicate where the user is to staple the desired contents of the report.

Indicating means 199 can also comprise indentations stamped into second inner strip 180, of front cover strip 170. See FIG. 22A.

Lastly provided in system 100 of this embodiment is the report front cover 116. Report front cover 116 may be formed separately from back cover 114, but in a preferred style, is formed integrally with it. Front cover 116 has short upper edge 127 and a short lower edge 129. It also has long vertical side edges 126 and 128. Long vertical side edge 126 is preferably formed integrally with lateral edge 121 of back cover sheet 114 along a third common joining or vertical fold line 143. See FIG. 22A. Report front cover 116 may also have at least one cutout section, which in this embodiment is shown as window opening 140.

As shown in FIGS. 22A–C, to enclose desired content in the report cover system of this eleventh embodiment, the user secures the report contents to the front cover strip. Preferably this is done by securing report content 105 to the outer portion of second inner strip 180 of cover strip 170 so that the outer face of the first page of the report content is in contact with the outer portion of second inner strip 180. The report content is secured to the front cover strip with ordinary staples in the marked locations. Next, the user folds inner strip 180 over outer strip 190 along fold line 133. The user then folds both first and second strips 180 and 190 over back cover sheet 114 along fold line 123. Finally, the user closes the cover system by folding the report front cover 116 laterally over the report contents and tucking the upper edge 127 into the groove created by and between the report contents 105 and the front cover strip 170.

SUMMARY

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents to which resort may be had fall within the scope of the invention.

What is claimed as being new and desired to be protected by Letters Patent of the United States is as follows:

1. A report cover comprising:

a back cover, a front cover attached to a first edge of said back cover, and a first front cover strip attached to a second edge of said back cover, said first front cover strip having at least one large cutout section therethrough, and a second outer front cover strip attached to said first front cover strip opposite said back cover, and wherein the second front cover strip includes at least one printed mark, visible through said large cutout section in said first front cover strip, for indicating where the user is to secure content pages thereto so as to create a groove between the attached content pages and the second front cover strip into which an edge of the front cover can be tucked.

2. A report cover system of claim 1 wherein said front cover is opposite to said first and second front cover strips.

3. A report cover system of claim 1 wherein said first and second front cover strips are oriented perpendicular to said front cover.

4. A report cover system of claim 1 wherein the back cover has two vertical edges, and wherein the front cover is affixed to one vertical edge of the back cover and the first front cover strip is affixed to the other vertical edge of the back cover.

5. A report cover system of claim 1 wherein the back cover has a lower edge and an upper edge, and wherein the front cover is affixed to the lower edge of the back cover and the first front cover strip is affixed to the upper edge of the back cover.

6. A report cover system of claim 1 wherein the back cover has a lower edge and an upper edge, and wherein the front cover is affixed to the upper edge of the back cover and the first front cover strip is affixed to the lower edge of the back cover.

7. A report cover system of claim 1 wherein the back cover has a lower edge, an upper edge, a left edge, and a right edge, and wherein the front cover is affixed to said right edge of the back cover and the first front cover strip is affixed to said upper edge of the back cover.

8. A report cover system of claim 1 wherein the front cover is integrally affixed to the back cover.

9. A report cover system of claim 1 wherein the report cover system is formed from one sheet of suitable material.

10. A report cover system of claim 1 wherein the system is formed of pliable material selected from the group consisting of paper, paperboard, cardboard, fiberboard, composition board, plastic, fabric and leather.

11. A report cover system of claim 1 wherein the indicating means comprise indentations in said second front cover strip visible to the user.

12. A report cover system of claim 1 wherein the indicating means comprise printed markings on said second front cover strip.

13. A report cover system of claim 1 wherein the front cover includes means for securing supplemental material(s) thereto.

14. A report cover system of claim 1 wherein the front cover has at least one window-like cutout opening therein through which content can be viewed.

15. A report cover system of claim 1 wherein the front cover includes content at the inner face of the front cover, such that said content remains visible as the user turns the pages of the report contents.

16. A report cover system of claim 15 wherein said content is selected from the group consisting of textual material, photographic material, and graphic material.

17. A report cover system comprising a back cover, a front cover attached to an edge of said back cover, and a first front cover strip attached to an edge of said back cover said front cover, and a second outer front cover strip attached to said first front cover strip opposite said back cover, wherein said second inner front cover strip has a tuck extension flap integrally attached thereto, wherein the second front cover strip includes means for attaching content pages to the second front cover strip so as to create a groove between the attached content pages and the second front cover strip into which an edge of the front cover can be tucked.

18. A report cover system of claim 17 wherein said tuck extension flap is formed separately from, and then secured to, said second inner front cover strip.

19. A report cover system of claim 18 wherein content securing means secures the tuck extension flap between said second inner front cover strip and the report contents.

20. A report cover comprising:

a back cover, a front cover, a front cover flap, and a front cover strip having an outer face and an inner face, wherein the front cover is affixed to the back cover at a first location, and said front cover strip is affixed to the back cover at a second location, which is opposite to said first location, wherein the front cover flap is affixed to said front cover strip opposite said back cover, wherein said front cover strip includes means for attaching content pages thereto so as to create a groove between the attached content pages and said front cover strip into which an edge of the front cover can be tucked, and wherein the front cover flap is adapted to fold over the front cover when the front cover of the report is in the closed position.

21. A report cover comprising:

a back cover, said back cover including first and second edges, wherein said second edge is adjacent and in a perpendicular orientation to said first edge, a front cover including a third edge and a fourth edge, said fourth edge perpendicular to said third edge, said front cover attached at said third edge to said first edge of said back cover, a first front cover strip attached to said second edge of said back cover, and, a second outer front cover strip attached to said first front cover strip opposite said back cover, wherein the second front cover strip includes means for attaching content pages to an inner face of the front cover strip so as to create a groove between the attached content pages and the second front cover strip, and wherein said third edge of said front cover is shorter than said first edge of said back cover such that said fourth edge of the front cover can be tucked into said groove.

22. A report cover comprising:

a back cover, a front cover attached to a first edge of said back cover, and a first front cover strip attached to a second edge of said back cover, said first front cover strip having at least one large cutout section therethrough, and a second outer front cover strip attached to said first front cover strip opposite said back cover, and wherein the second front cover strip includes at least one indentation, visible through said large cutout section in said first front cover strip, for indicating where the user is to secure content pages thereto so as to create a groove between the attached content pages and the second front cover strip into which an edge of the front cover can be tucked.

* * * * *

UNITED STATES PATENT AND TRADEMARK OFFICE

CERTIFICATE OF CORRECTION

PATENT NO. :6,047,990

DATED : April 11, 2000

INVENTOR(S) :Larry Leibe Mogelonsky, Spencer Wynn & Douglas G. Schwartz

It is certified that error appears in the above-identified patent and that said Letters Patent is hereby corrected as shown below:

At column 1, line 40, insert -a- between "for" and "new".

At column 2, line 10, change "plys" to -plies-.
At column 6, line 10, change "a" to -an-.
At column 16, line 60, insert -opposite- between "cover" and "said".

Signed and Sealed this

Twenty-seventh Day of February, 2001

Attest:

Nicholas P. Godici

NICHOLAS P. GODICI

Attesting Officer

Acting Director of the United States Patent and Trademark Office